US006138290A

United States Patent [19]

Lin

[11] Patent Number: 6,138,290

[45] Date of Patent: Oct. 31, 2000

[54] MOVABLE FITTING MEMBERS FOR USE WITH DRAIN FITTINGS

[76] Inventor: Michael C. H. Lin, 11F, No. 9, Kuang-Fu N. Road, Taipei, Taiwan

[21] Appl. No.: 09/454,214

[22] Filed: Dec. 9, 1999

[51] Int. Cl.[7] ..... A47K 1/14

[52] U.S. Cl. ..... 4/295; 4/286; 4/293

[58] Field of Search ..... 4/286–295

[56] References Cited

U.S. PATENT DOCUMENTS

| | | | |
|---|---|---|---|
| 2,731,649 | 1/1956 | Valentine | 4/286 |
| 4,420,844 | 12/1983 | Puckett et al. | 4/286 |
| 4,720,877 | 1/1988 | Watts | 4/286 |
| 4,926,507 | 5/1990 | Craig et al. | 4/286 |
| 5,072,461 | 12/1991 | Logsdon | 4/286 |
| 5,758,368 | 6/1998 | Ball | 4/295 |
| 5,832,544 | 11/1998 | Pan | 4/286 |

*Primary Examiner*—Charles Eloshway

[57] ABSTRACT

A movable fitting member for use with a drain fitting for controlling the discharging of fluid, comprises a drain fitting, a cylindrical guide post with an inserting plate, a lower bearing portion, and a fitting member. If the guide post is in a position that the inserting plate thereof is aligned with a deeper groove within fitting member, it will insert into the bore at its full length, so that the fitting member tightly covers the drain and thus, fluid is sealed and does not discharge out. However, if the guide post is aligned with a shallow groove formed by the second and fourth slots and the cylindrical bore, it will insert into the fitting member by only a part of its full length, so that the fitting member does not completely cover the drain fitting and thus a gap is formed therebetween. Therefore, water discharges therefrom. Moreover, an O ring can be added to the lower internal bore, by engaging between the O ring and a neck portion in the guide post, a gap is also formed between the fitting member and drain fitting, therefore, water discharges therefrom.

2 Claims, 9 Drawing Sheets

(B-B)

MOVABLE FITTING MEMBERS FOR USE WITH DRAIN FITTINGS

FIELD OF THE INVENTION

The present invention relates to a novel and improved movable fitting member for use with drain fittings, and especially to a movable fitting member for use with a drain fitting that normally such fitting member will be formed so as to serve as a stopper or closure for the drain fittings in bath or the like, but if desired, they can also be formed so as to be useful in connection with or as strainers or related items.

BACKGROUND OF THE INVENTION

The drain fittings with which the fitting members of the present invention are primarily useful are normally constructed as so to include an upper annular rim which is shaped so as to be especially adapted to fit against the bottom of the tub or a sink around a drain opening. These drain fittings usually include an externally threaded cylindrical sleeve which is attached to the interior of the annular lip, inwardly extending arms carried by the lower end of the sleeve and a post holder carried by the arms.

U.S. Pat. No. 5,072,461, disclosed by Duane D. Logsdon, has disclosed such a movable fitting member which constructs a movable fitting member such as a bathtub drain stopper so as to be useful with different sized openings but differs by having post holders with different sized openings into which a guide post can be threaded. Such a movable fitting member is constructed so as to use a body having a sleeve located around a post holder within the body. The guide post used is double ended. One end is threaded into the post holder in a drain fitting and the other end is located within the cavity. A nut is located on the other end. It is sufficiently large so that it cannot pass though the sleeve. As a result of this, the body can not normally be separated from the guide post during the use of the fitting member.

SUMMARY OF THE INVENTION

A broad objective of this invention is to fulfil this need. More specifically an object of the invention is to provide new and improved fitting members such as stoppers or drain closures, strainers or the like which are of such a category that they can be easily and conveniently used as replacements for fitting members used with either of the two common types of drain fittings indicated in the preceding discussion. Because of the fact that the fitting member of the invention can be used with common types of drain fittings as noted a plumbing supply house or plumber will need to carry only a fitting member in accordance with this invention in order to have a single type of fitting member to meet commercial needs instead of having two of such fitting members in order to meet these needs.

Accordingly, the primary object of the present invention is to provide a movable fitting member used with a drain fitting for controlling the discharging of fluid, comprising a drain fitting, a cylindrical guide post with an inserting plate, a lower bearing portion, and a fitting member. If the guide post is in a position that the inserting plate is aligned with a deep groove within the fitting member, it will insert into the bore at its full length, so that the fitting member tightly covers the drain and thus, fluid is sealed and does not discharge out. Whereas, if the guide post is aligned with a shallow groove, it will insert into the fitting member by only a part of its full length, so that the fitting member does not completely cover the drain fitting and thus a gap is formed therebetween, therefore, water discharges therefrom.

The various objects and advantages of the present invention will be more readily understood from the following detailed description when read in conjunction with the appended drawings.

DETAILED DESCRIPTION OF THE PREFERRED EMBODIMENTS

Figure 1:
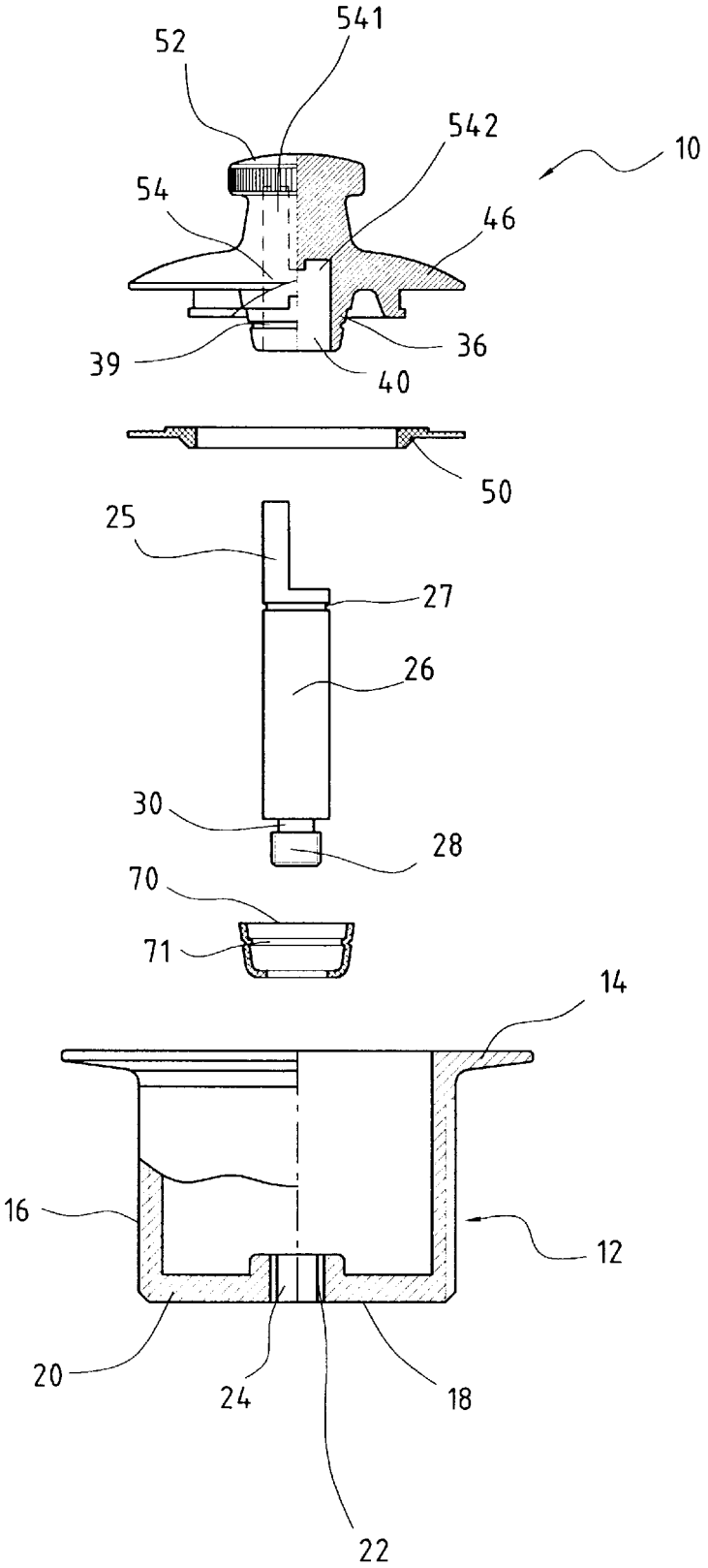
FIG. 1 is an exploded cross sectional view showing the components in the first embodiment of the present invention.
Figure 2:
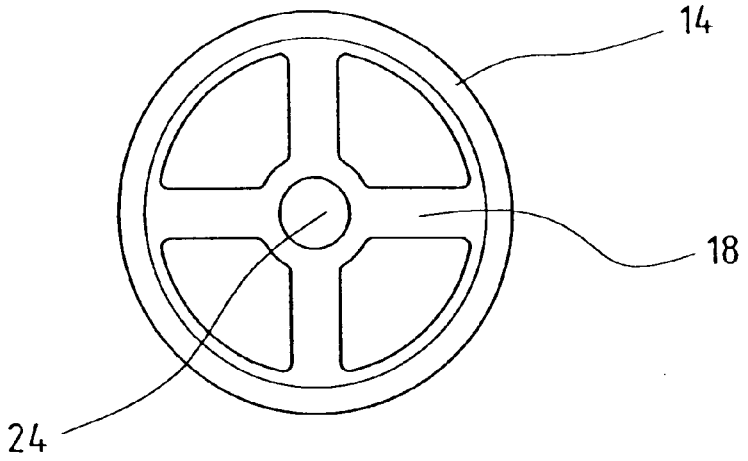
FIG. 2 shows the lateral view of the drain fitting in the first embodiment of the present invention.

With reference to FIG. 1, in the drawing there is shown a movable fitting member 10 which is used with a drain fitting 12. Normally the drain fitting 12 will be of a standardized construction and will include: an upper angular lip section 14; an external cylindrical sleeve 16 which is attached to and depends from the interior of the lip section 14, a series of arms 18 as shown in FIG. 2 extended inwardly from the lower end 20 of the sleeve 16; and a post holder 22 having an internally threaded opening 24 supported by the arms 18.

It is to be understood that the precise construction of the drain fitting 12 and fitting member 10 depends upon the desires of a manufacturer. It is to be understood that the precise construction of the fitting member 10 can be varied extensively depending upon the desires of manufacturer. It will be also very dependent upon the precise use of the fitting member. Thus, the construction of the fitting member 10 will have to depend upon whether it is intended to be used as a stopper or drain closure or whether or not it is intended to be used as a strainer or a drain closure.

Figure 3:
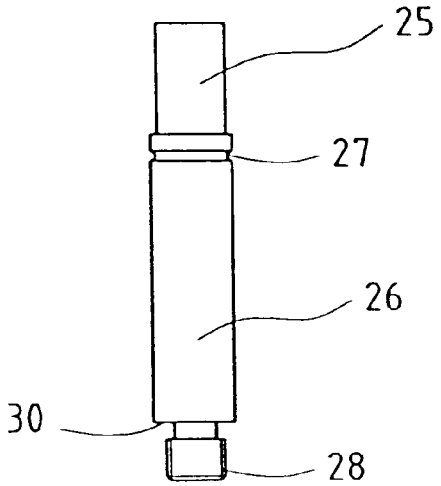
FIG. 3 is another lateral view of the guiding post in the first embodiment of the present invention showing another view of the inserting plate.

A cylindrical guide post 26 has a threaded lower end 28 of such a diameter that this end 28 can be threaded into the threaded opening 24 so that a shoulder 30 on the post 26 fits tightly against the holder 22 in order to securely hold the post 26 so that it extended upwards through the sleeve 16 in axial alignment with the sleeve 16. Moreover, the guide post 26 has an inserting portion 25 at the upper end thereof, a lateral view of the guide post 26 is shown in FIG. 3, it is shown that the inserting portion 25 is a cambered plate with two surfaces in the longitudinal direction, one is a cambered surface and the other one has a flat surface. There is a neck portion 27 formed between the inserting portion 25 and the guide post 26.

A lower bearing portion 70 has a ring slot 71. The depth of the ring slot 70 is more shallow than the depth of the groove 39, while the width of the ring slot 70 is narrower than that of the groove 39.

The fitting member 10 also includes a body 36 which is adapted to be moved linearly relative to the post 26. This body 36 is shaped so as to include a lower internal bore 40 which fits closely around the post 26 as shown in order to mount the body 36 for this movement.

This body 36 also includes a conventional annular somewhat elastomeric, natural or synthetic rubber sealing washer 50 which is held against the exterior (not separately numbered) of the body 36 between the flange 46 so as to extend outwards from the flange 46 with a sufficient distance so as to be capable of fitting against the lip section 14 to form a seal with this lip section 14 when the fitting member 10 is in a closed position. The flange 46 is of such a size as to "back up" the washer 50 so that it can not become wedged to the sleeve 16.

A nearly or general cylindrical cap 52 is used in order to move the fitting member 10—including the body 36—between open and closed positions. This cap 52 includes a centrally located cylindrical bore 54 which is adapted to accommodate the upper end of the post 26. This bore 54 should preferably be smaller in diameter than the bore 40. The reason for this will be subsequently apparent.

Figure 4:
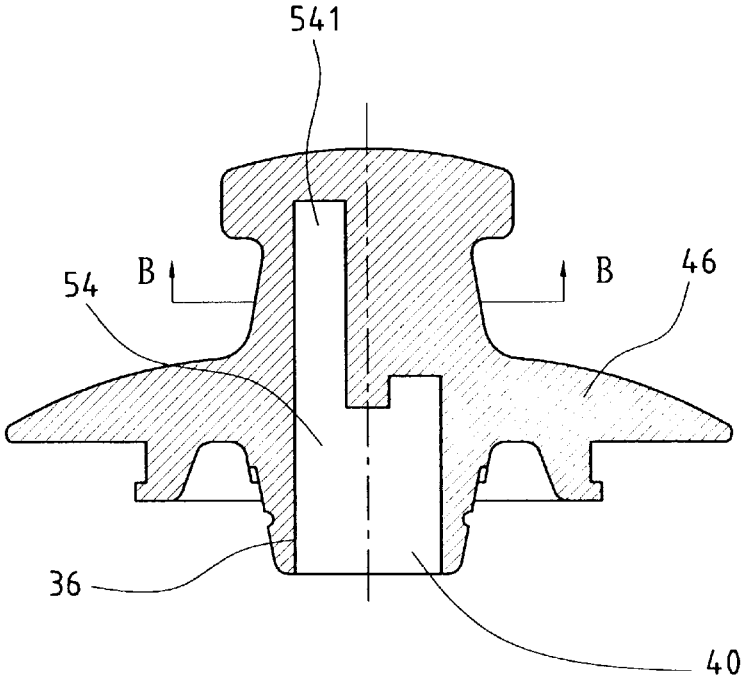
FIG. 4 is a cross sectional view of the fitting member in the first embodiment with a deep slot and a shallow slot being displayed.
Figure 5:
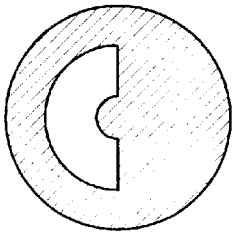
FIG. 5 is a cross sectional view of the bore in the fitting member in the first embodiment, especially showing the cross sections of the deep slot and the shallow slot.

The special feature of the present invention is that the diameter of the lower internal bore 40 is larger than that of the guide post 26. Furthermore, as shown in FIGS. 4 and 5, the cylindrical bore 54 is formed by a deep slot 541, and a shallow slot 542. The deep slot 541 is deeper than the shallow slot 542 and the depth of the deep slot 541 is slightly larger than the depth of the inserting plate 25. The shape of the deep slot 541 may fit the shape of the inserting plate 25 so that the inserting plate can insert into the deep slot 541. While the depth of the shallow slot 542 is shallower than the depth of the bore 54. Similarly, the shape of the shallow slot 542 can fit the shape of the inserting plate 25.

Thus, if the guide post 26 is in a position that the inserting plate is aligned with the deep slot 541, it will insert into bore 54 at its full length, so that the fitting member 10 covers the drain fitting 12 with the washer 50 tightly abutting against the upper angular lip section 14 so that the water is sealed and does not discharge fluid. Whereas, if the guide post 26 is aligned with the slots 542, it will insert into bore 54 only a part of its full length, so that the fitting member 10 does not completely cover the drain fitting 12 and thus a gap is formed between the washer 50 and the upper angular lip section 14, therefore, water discharges therefrom.

In assembly, at first, the washer is tightly adhered to the lower portion of the fitting member 10. Next, the guide post 26 is loosely inserted into the lower internal bore 40 and thus it may rotate therewithin. Next, the lower bearing portion 70 passes over the guide post 26 to engage with the body 36 of the fitting member by tight connection of the groove 39 and the ring slot 71. Now, the guide post 26 can still rotate therewithin. Next, the guide post 26 is screwedly connected to the drain fitting by screwing into the thread of the threaded opening 24. Therefore, the assembly of the present invention is complete.

Figure 6:
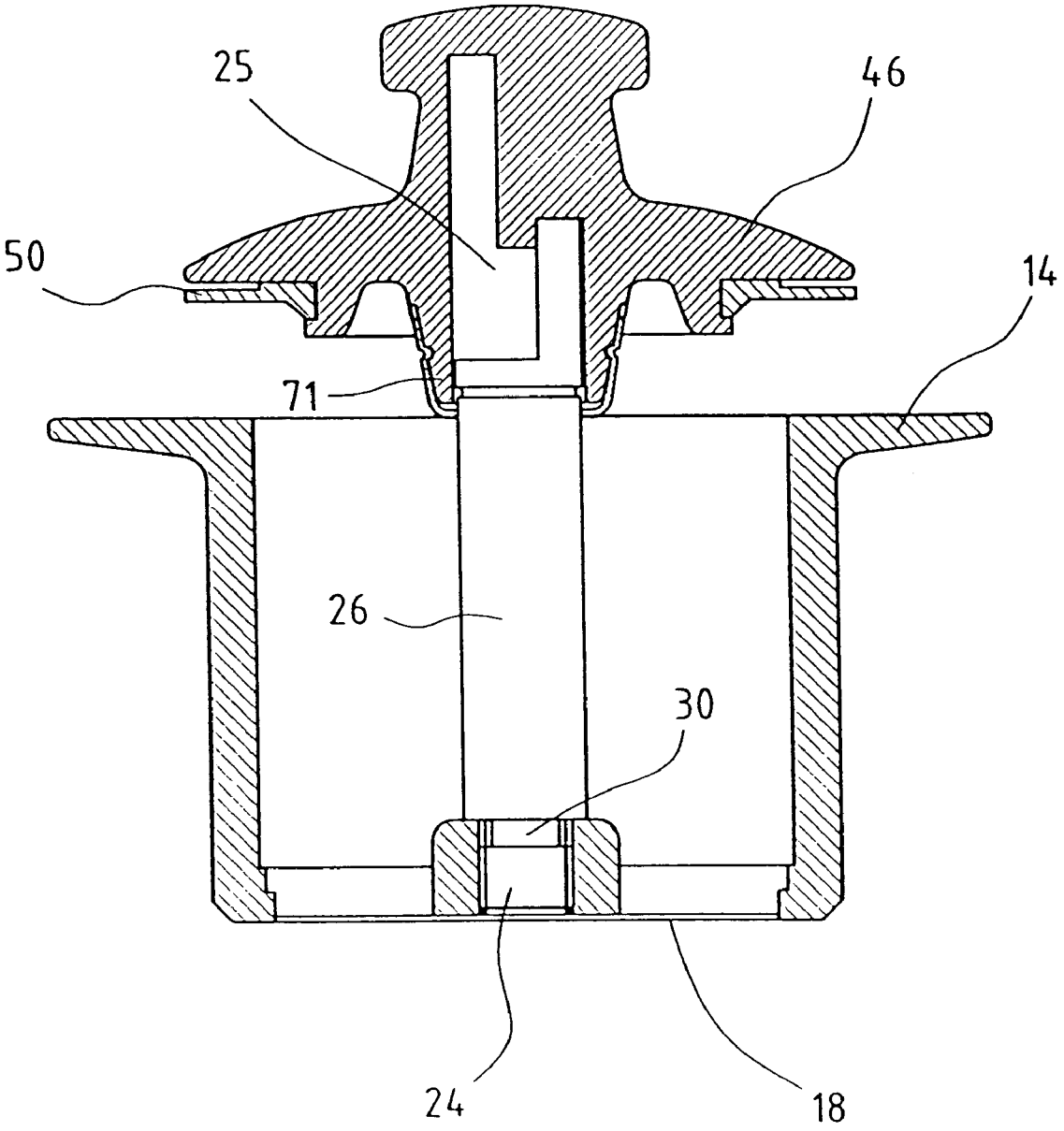
FIG. 6 is a cross sectional view showing an assembled fitting member and drain fitting in the first embodiment with the guide post in a position causing a gap formed between the drain fitting and fitting member.
Figure 7:
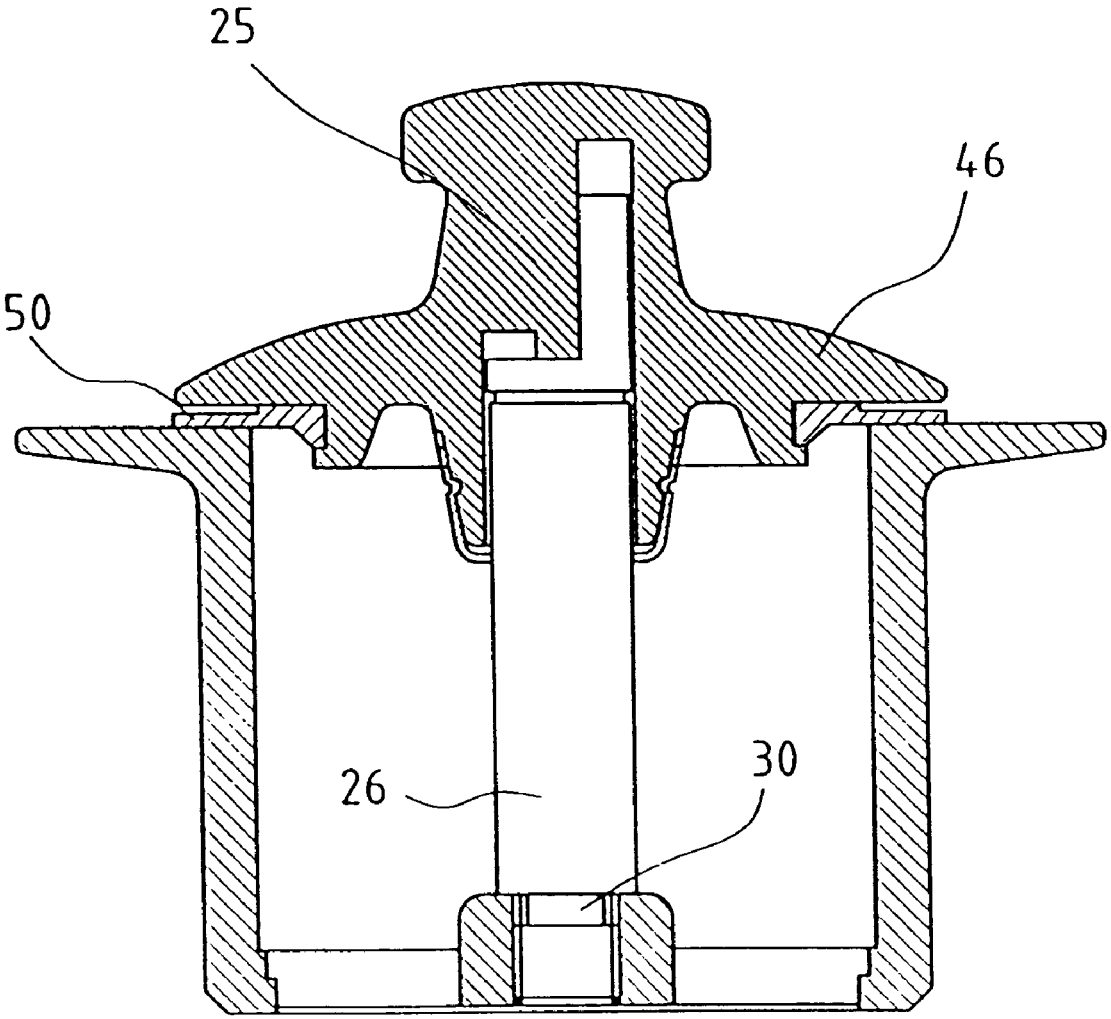
FIG. 7 is a cross sectional view showing an assembled fitting member and drain fitting in the first embodiment with the guide post in a position causing no gap formed between the drain fitting and fitting member.

Now, the guide post 26 can rotate freely. If it is exactly rotated to the position so that the inserting plate is fitted into the slot 542, just a part of the inserting plate 25 is inserted into the cylindrical bore 54 as shown in FIG. 6. Thus, it is apparently that a gap is formed between the fitting member 10 and the drain fitting 12. Now, fluid may flow through this gap so as to be discharged. Alternatively, if the guide post 26 is exactly rotated to the position so that the plate is fitted into the slot 541, the inserting plate 25 can be inserted into the cylindrical bore 54 at its full length as shown in FIG. 7. Thus, it is apparently that no gap is formed between the fitting member 10 and the drain fitting 12 and thus no fluid may flow through this gap for discharging.

FIGS. 8 to 11 illustrates another embodiment of the present invention. Wherein the structure in this embodiment is similar to that of the aforesaid embodiment except that an O ring 29 is further added. Therefore, those identical components in these two embodiments will not be further described herein. Moreover, the identical components in these two embodiments are indicated by identical numerals, and the details of these components will not be further described, which may refer to the aforesaid description.

Figure 8:
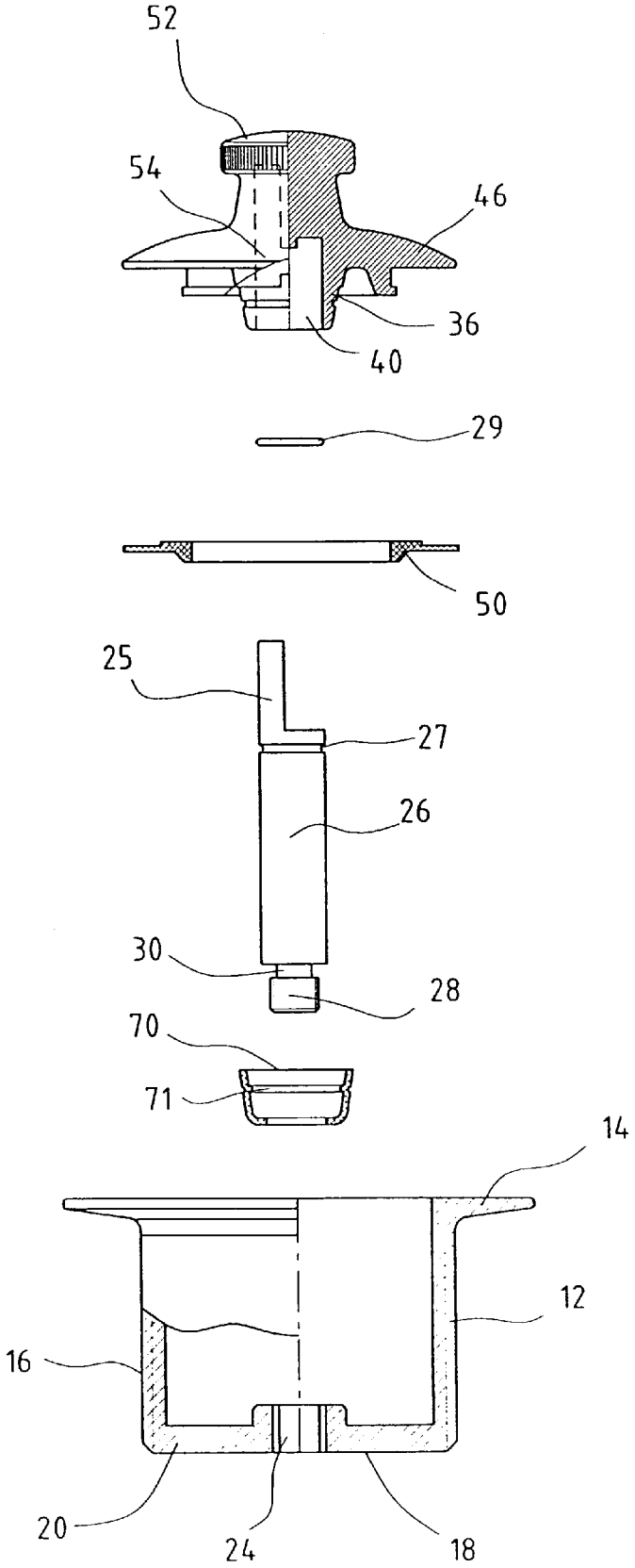
FIG. 8 is an exploded cross sectional view showing the components in the second embodiment of the present invention.
Figure 9:
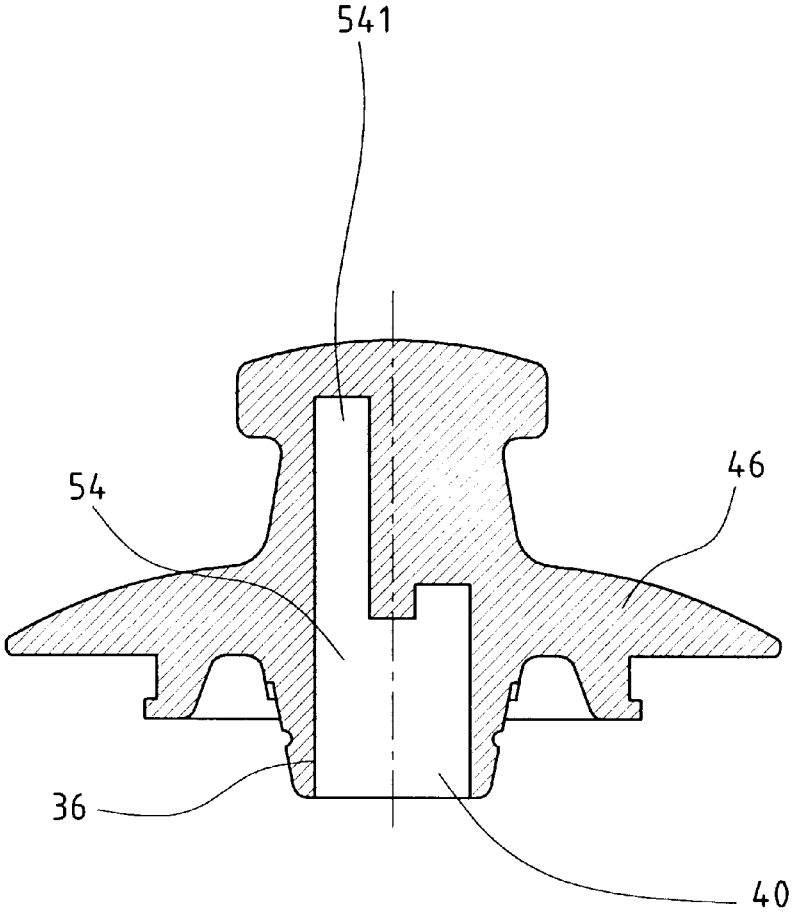
FIG. 9 shows the lateral view of the fitting member in the second embodiment of the present invention.

Referring to FIG. 8, the O ring 29 is made of flexible materials, and have an outer diameter slightly larger than the inner diameter of the lower internal bore 40 and an inner diameter slightly smaller than the inner diameter of the neck portion 27.

Figure 10:
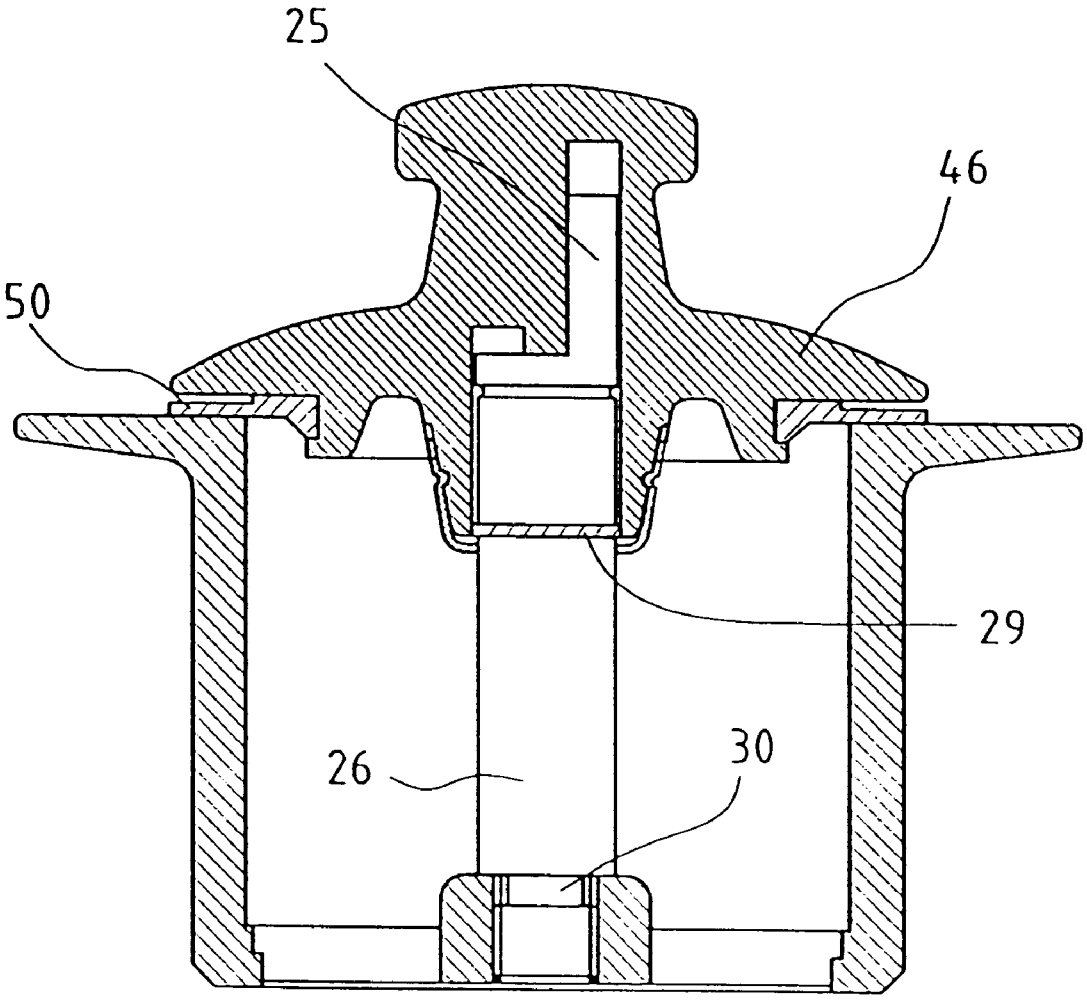
FIG. 10 is a cross sectional view showing an assembled fitting member and drain fitting in the second embodiment with the guide post in a position causing no gap formed between the drain fitting and fitting member.
Figure 11:
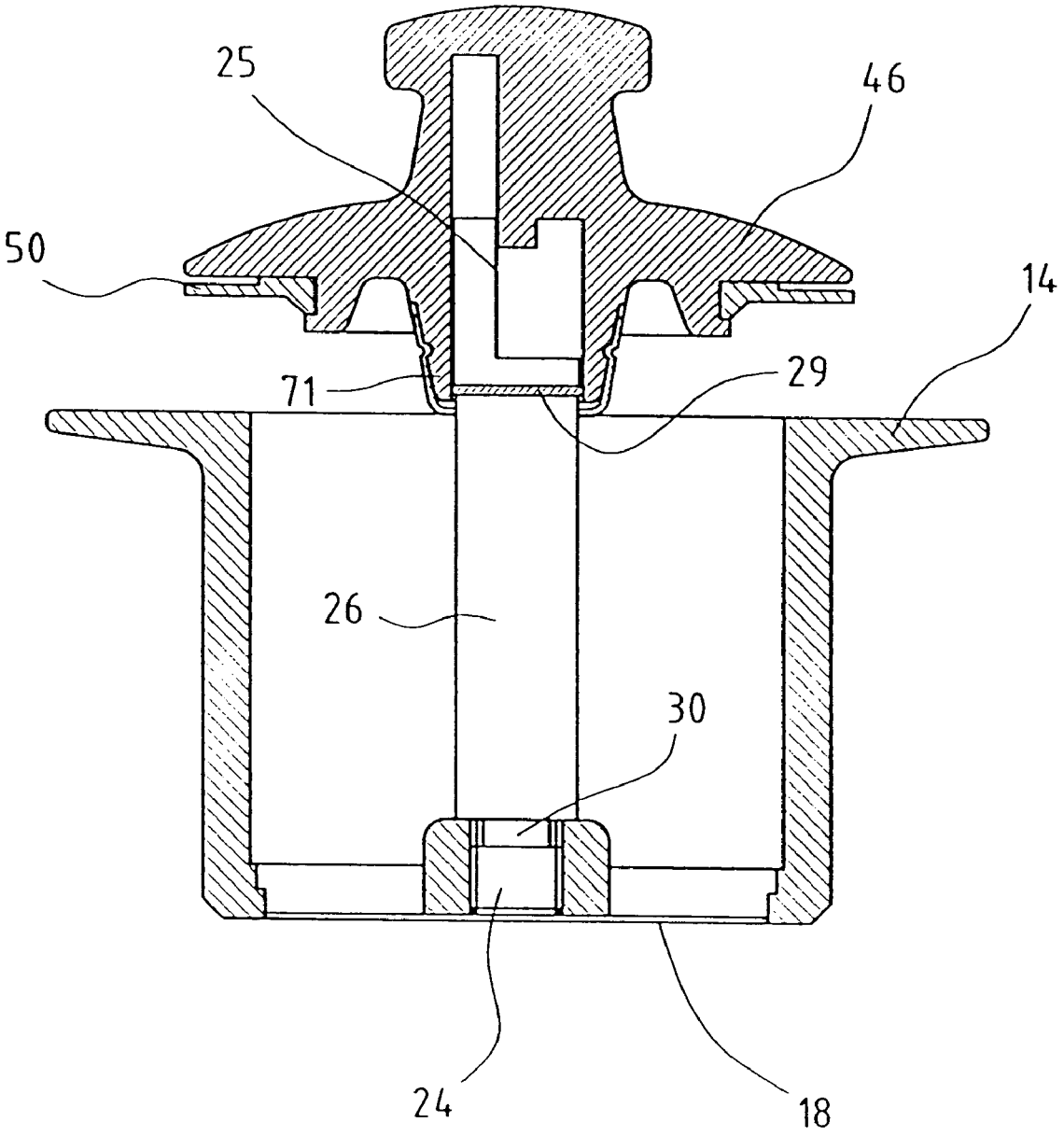
FIG. 11 is a cross sectional view showing an assembled fitting member and drain fitting in the second embodiment with the guide post in a position causing a gap formed between the drain fitting and fitting member.

The assembling way of this embodiment is identical to that in the aforesaid embodiment. Only the O ring 29 is adhered to the lower edge of the lower internal bore 40 as that shown in FIG. 10. Therefor, since the guide post 26 may rotate freely. If the guide post 26 is exactly rotated to the position so that the plate is fitted into the slot 541, the inserting plate 25 can be inserted into the cylindrical bore 54 at its full length as shown in FIG. 10. Thus, it is apparently that no gap is formed between the fitting member 10 and the drain fitting 12 and thus no fluid may flow through this gap for discharging. Operation of this part is identical to that described above. Alternatively, if the user desires to open the fitting member 10 so as to drain water, the movable fitting member 10 can be lift upward so that the O ring 29 on the lower internal bore 40 will engage with the neck portion 27. Since the inner diameter of the O ring 29 is slight smaller that the outer diameter of the neck portion 27, thus a firm engagement can be formed therebetween. As a result, just a part of the inserting plate is inserted into the cylindrical bore 54 as shown in FIG. 11. Thus, it is apparently that a gap is formed between the fitting member 10 and the drain fitting 12. Now, fluid may flow through this gap so as to be discharged.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A movable fitting for controlling discharging of fluid, comprising:

a drain fitting including a lip section; an external cylindrical sleeve which is attached to and depends from the interior of the lip section, a series of arms extended inwardly from a lower end of the sleeve; and a post holder having an internally threaded opening supported by the arms;

a guide post having a shoulder and a threaded lower end of such a diameter so that the guide post can be threaded into the threaded opening so that the shoulder on the post fits tightly against the holder; an inserting portion at an upper end thereof, the inserting portion being a thin flat plate;

a lower bearing portion having a ring slot;

a fitting member including a body which is adapted to be moved linearly relative to the post, the body being shaped so as to include a lower internal bore which fits closely around the post in order to mount the body for movement; the body also including a washer held against the exterior of the body; and a generally cylindrical cap including a centrally located bore which is adapted to accommodate the upper end of the post; characterized in that:

the diameter of the lower internal bore is larger than that of the guide post;

the centrally located bore has a deep slot and a shallow slot, the deep slot is deeper than the shallow slot and the depth of the deep slot is slightly larger than the depth of the inserting plate, the shape of the deep slot fits the shape of the inserting plate so that the inserting plate can insert into the deep slot; the shape of the shallow slot fits the shape the inserting plate;

in assembly, at first, the washer is tightly adhered to the lower portion of the fitting member, next, the guide post is loosely inserted into the lower internal bore and thus it may rotate therewithin, next, the lower bearing portion passes over the guide post to engage with the body of the fitting member, now, the guide post can still rotate therewithin, next, the guide post is screwedly connected to the drain fitting by screwing into the thread of the threaded opening, therefore, the assembly of the present invention is complete; wherein if the guide post is in a position that the inserting plate is aligned with the deep slot, it will insert into the centrally located bore at its full length, so that the fitting member covers the drain fitting with the washer tightly abutting against the lip section so that the drain fitting is sealed and does not discharge fluid; whereas, if the inserting plate is aligned with the shallow slot, it will insert into bore only a part of its full length, so that the fitting member does not completely cover the drain fitting and thus a gap is formed between the washer and the lip section, therefore, water discharges therefrom.

2. A movable fitting for controlling discharging of fluid, comprising:

a drain fitting including a lip section; an external cylindrical sleeve which is attached to and depends from the interior of the lip section, a series of arms extended inwardly from a lower end of the sleeve; and a post holder having an internally threaded opening supported by the arms;

a guide post having a neck portion, a shoulder, and a threaded lower end of such a diameter so that the guide post can be threaded into the threaded opening so that the shoulder on the post fits tightly against the holder; an inserting portion at an upper end thereof, an inserting portion being a thin flat plate;

a lower bearing portion having a ring slot;

a fitting member including a body which is adapted to be moved linearly relative to the post, the body being shaped so as to include a lower internal bore which fits closely around the post in order to mount the body for movement; the body also including a washer held against the exterior of the body; and a generally cylindrical cap including a centrally located bore which is adapted to accommodate the upper end of the post;

an O ring made of flexible material, and having an outer diameter slightly larger than the inner diameter of the lower internal bore and an inner diameter slight smaller than the inner diameter of the neck portion; characterized in that:

the diameter of the lower internal bore is larger than that of the guide post;

the centrally located bore has a deep slot and a shallow slot, the deep slot is deeper than the shallow slot and the depth of the deep slot is slightly larger than the depth of the inserting plate, the shape of the deep slot fits the shape of the inserting plate so that the inserting plate can insert into the deep slot; the shape of the shallow slot fits the shape the inserting plate;

in assembly, at first, the washer is tightly adhered to the lower portion of the fitting member, next, the guide post is loosely inserted into the lower internal bore and thus it may rotate therewithin, next, the lower bearing portion passes over the guide post to engage with the body of the fitting member, now, the guide post can still rotate therewithin, next, the guide post is screwedly connected to the drain fitting by screwing into the thread of the threaded opening, therefore, the assembly of the present invention is complete; the O ring is adhered to the lower edge of the lower internal bore; to allow the guide post rotate freely; wherein the guide post is exactly rotated to the position so that the plate is fitted into the deep slot, the inserting plate can be inserted into the cylindrical bore at its full length; thus, no gap is formed between the fitting member and the drain fitting and thus no fluid may flow through this gap for discharging; alternatively, if the user desires to open the fitting member so as to drain water, the movable fitting member can be lift upward so that the O ring on the lower internal bore will engage with the neck portion; as a result, just a part of the inserting plate is inserted into the cylindrical bore; and, a gap is formed between the fitting member and the drain fitting so that fluid may flow through this gap so as to be discharged.

* * * * *